US005711328A

United States Patent [19]

Braun

[11] Patent Number: 5,711,328

[45] Date of Patent: Jan. 27, 1998

[54] CLEANING DEVICE FOR THE SHAVING HEAD OF A DRY SHAVER

[75] Inventor: Gebhard Braun, Kelkheim, Germany

[73] Assignee: Braun Aktiengesellschaft, Frankfurt, Germany

[21] Appl. No.: 376,849

[22] Filed: Jan. 23, 1995

[30] Foreign Application Priority Data

Jan. 26, 1994 [DE] Germany ..... 44 02 238.7

[51] Int. Cl.[6] ..... B08B 3/04

[52] U.S. Cl. ..... 134/111; 134/116; 134/135; 134/186; 134/201

[58] Field of Search ..... 134/135, 201, 134/198, 102.3, 116, 23, 24, 186, 111; 30/41, 41.3

[56] References Cited

U.S. PATENT DOCUMENTS

| | | | |
|---|---|---|---|
| 412,461 | 10/1889 | Canon | 134/201 |
| 1,105,045 | 7/1914 | Shipherd | 134/111 |
| 1,782,793 | 11/1930 | Piccione | 134/88 |
| 2,485,968 | 10/1949 | Hilliker | 134/111 |
| 2,595,838 | 5/1952 | Fugue | 134/111 |
| 2,675,012 | 4/1954 | Scales | 134/111 |
| 3,041,212 | 6/1962 | Booth | 134/155 |
| 3,096,776 | 7/1963 | DeWitt | 134/111 |
| 3,172,416 | 3/1965 | Simmons . | |
| 3,227,167 | 1/1966 | Parent, Jr. | 134/109 |
| 3,365,267 | 1/1968 | Mekiney et al. | 134/111 |
| 3,378,019 | 4/1968 | Riolo et al. | 134/111 |
| 3,480,022 | 11/1969 | Richardson et al. | 134/135 |
| 3,876,649 | 4/1975 | Schimke | 134/95 |
| 3,890,988 | 6/1975 | Lee | 134/111 |
| 3,908,681 | 9/1975 | Schimke et al. | 134/95.2 |
| 4,054,963 | 10/1977 | Taylor . | |
| 4,105,342 | 8/1978 | Plourde | 134/111 |
| 4,442,596 | 4/1984 | Nasu | 30/41.5 |
| 4,462,415 | 7/1984 | Otzen | 134/111 |
| 4,549,352 | 10/1985 | Ochiai et al. | 30/41.5 |
| 4,597,126 | 7/1986 | Beech | 134/155 |
| 4,631,825 | 12/1986 | Kurigama et al. | 30/43.92 |
| 4,730,631 | 3/1988 | Schwartz | 134/170 |
| 4,815,486 | 3/1989 | Schinn | 134/155 |
| 4,991,609 | 2/1991 | Browning | 134/184 |
| 5,064,521 | 11/1991 | Stepanenko et al. | 204/224 |
| 5,095,925 | 3/1992 | Elledge et al. | 134/184 |
| 5,118,357 | 6/1992 | Sabatka | 134/64 R |
| 5,143,101 | 9/1992 | Mor | 134/108 |
| 5,156,813 | 10/1992 | Calhoun | 134/186 |
| 5,179,890 | 1/1993 | Reuveni et al. | 134/108 |
| 5,186,631 | 2/1993 | Kitajima | 134/164 |
| 5,318,356 | 6/1994 | Shelton | 312/223.1 |
| 5,333,628 | 8/1994 | Ogata et al. | 134/64 R |
| 5,335,394 | 8/1994 | Cunningham et al. | 134/135 |
| 5,456,275 | 10/1995 | Barish | 134/275 |

FOREIGN PATENT DOCUMENTS

| | | | |
|---|---|---|---|
| 808932 | 2/1937 | France | 134/281 |
| 2568111 | 1/1986 | France | A45D 27/46 |
| 2 568 11 | 7/1986 | France . | |
| 412981 | 5/1925 | Germany | 134/141 |
| 24 29 372 | 8/1976 | Germany . | |
| 06 178876 | 6/1994 | Japan . | |
| 87679 | 10/1936 | Sweden | 134/116 |
| 0 337 132 | 11/1930 | United Kingdom . | |
| 1 206 791 | 9/1970 | United Kingdom . | |
| 1 206 792 | 9/1970 | United Kingdom . | |
| 2 129 732 | 5/1984 | United Kingdom . | |

OTHER PUBLICATIONS

Copy of European Search Report dated May 16, 1995.

EP Search report dated Mar. 23, 1995.

Black & Decker, "Powerpro, Dustbuster Plus, Cordless Vacs", 1989,90, pp. 4, 8–9.

*Primary Examiner*—Frankie L. Stinson
*Attorney, Agent, or Firm*—Fish & Richardson P.C.

[57] ABSTRACT

The invention is directed to a cleaning device 5, with a cradle structure 7 receiving the shaving head 3 of a shaving apparatus 1, as well as at least one cleaning fluid container 6, 61 and a device adapted to be driven by a motor 28 for feeding the cleaning fluid, wherein the cradle structure 7 receiving the shaving head 3 is arranged separately from the cleaning fluid container 6 and is supplied with cleaning fluid from the container.

27 Claims, 8 Drawing Sheets

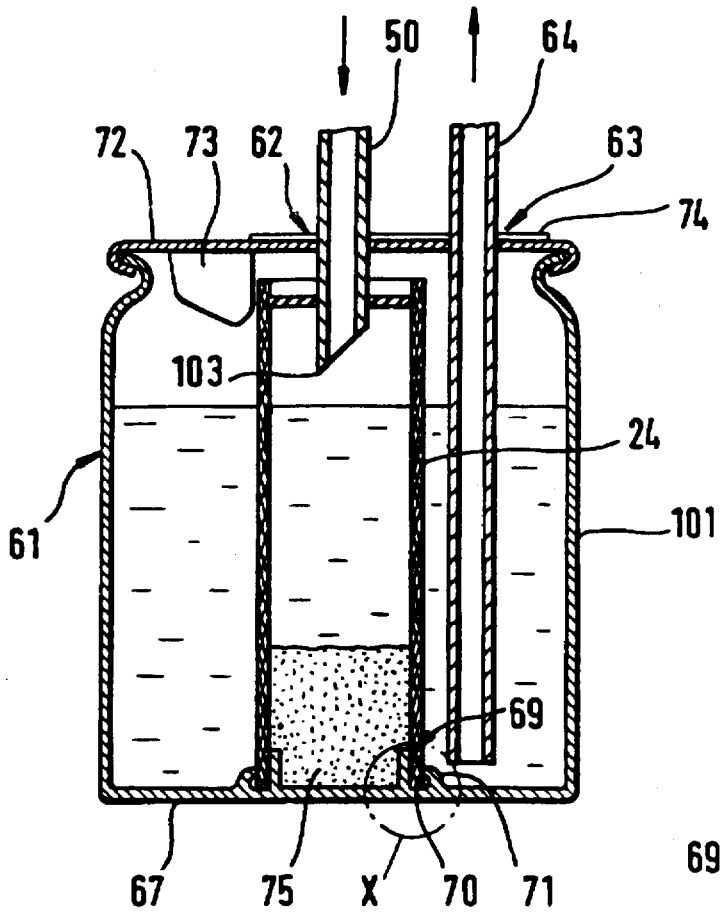
Fig. 7
Fig. 8
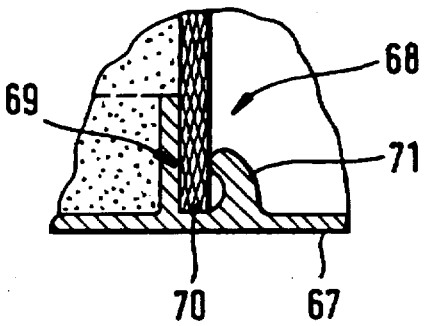
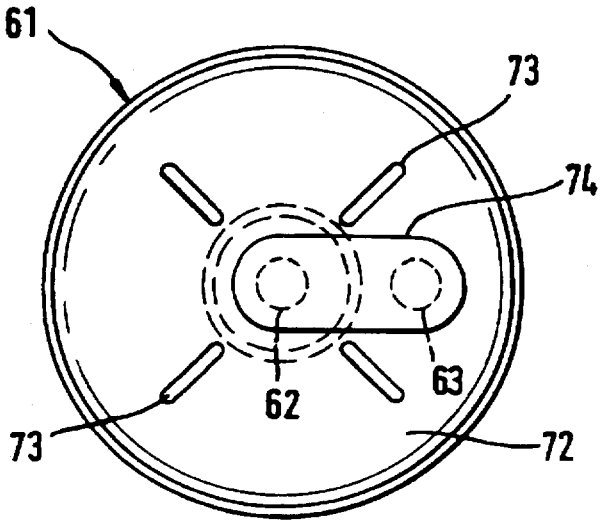
Fig. 9

CLEANING DEVICE FOR THE SHAVING HEAD OF A DRY SHAVER

This invention relates to a cleaning device, with a cradle structure receiving the shaving head of a shaving apparatus, as well as at least one cleaning fluid container and a device adapted to be driven by a motor for feeding the cleaning fluid.

From prior U.S. Pat. No. 3,172,416 a cleaning device for the cutter portion of a dry razor is known, comprising a cleaning casing in the upper area of which a seat is provided for receiving therein the cutter portion of an electric razor. According to a first embodiment, the individual components of the cutter portion are cleaned by a continuous stream of air directed to the cutter portion through an impeller means and filter elements. However, in cases where the cutter portion is severely contaminated carrying, for example, sebum, that is, grease particles, cleaning the cutter portion by means of an air stream is not accomplishable to the desired degree. The entire casing of the cleaning device through which air is blown is required to be sealed tight relative to atmosphere to prevent the swirled up hair dust from penetrating to the outside.

The same applies also to the cleaning device according to another embodiment (U.S. Pat. No. 3,172,416) in which the cutter portion is cleaned by a cleaning fluid directed for this purpose through fluid channels provided in the casing. For the full duration of the cleaning cycle, the cutter portion is seated in a cradle which is provided in the upper part of the casing and is at all times filled to capacity with cleaning fluid circulating therethrough. To accomplish this, a feed pump is provided in the casing. Because the cleaning fluid is not filtered during the cleaning operation, hair particles enter the cradle again and again, thus reaching the area of the cutter portion, so that this cleaning operation is equally not suited to accomplish satisfactory results, the less so since after deactivation of the pump device cleaning fluid with hair particles remain in the cradle, being thus prevented from being completely removed from the cutter portion. On termination of the cleaning cycle, it is necessary for the razor to be removed from its cradle to allow the cutter portion to drain and to be subsequently dried in the air. In this arrangement, the hair particles entrained with the cleaning fluid continue to adhere to the components of the cutter portion, so that ultimately a perfect cleaning action of the cutter portion is not achieved. The chamber provided in the lower part of the casing for collecting the cleaning fluid and the dirt particles must remain closed during recirculation of the cleaning fluid to prevent the dirt particle sediment accumulated therein from being agitated again. Yet it is not possible to prevent unfiltered cleaning fluid from being continuously directed against the cutter portion during circulation of the cleaning fluid.

It is a further disadvantage that the razor can be received in the cradle of the cleaning device only during the cleaning operation. Following cleaning, it is necessary for the razor to be removed to be deposited separately on a drip surface above the cradle.

From French Pat. No. 2,568,111 a device for cleaning a shaving head of a dry shaving apparatus is known, in which the shaving head is introduced through a wall configured as a membrane into a cleaning chamber, being subsequently held in a cleaning position by the wall of a lid. By means of air caused to flow by a fan means and/or a suction means, only loose hair dust, yet excluding hair dust adhering to the shaving head, is blown out or extracted and then transferred to a filter means. The additional cleaning actions proposed in combination with the suction device as performed by a brushing device, a vibrating device or an ionization device, are not suited for dislodging sebum with or without hair dust from all components of a shaving head—the inside of the shaving head frame, the outer cutter, the inner cutter—not even when the shaving head has been previously removed from the housing of a dry shaving apparatus or disassembled.

Accordingly, it is an object of the present invention to improve the cleaning device.

According to the present invention, this object is accomplished in that the cradle structure receiving the shaving head is arranged separately from the cleaning fluid container, and that cleaning fluid is fed from the container to perform the cleaning action.

With the feed pump, a continuous supply of cleaning fluid can be fed to the shaving head received in the separate cradle until the shaving head is completely clean. The feed pump of the cleaning device can then be turned off, and following drainage of the cleaning fluid from the cradle the shaving head can be dried while sitting in the cradle.

To this effect, it is advantageous to configure the cradle as a storage device for the shaving apparatus, which is associated with an electric arrangement for operating the shaving apparatus and the cleaning device, or the shaving apparatus, the cleaning device and an air-drying device. Rather than being required to be removed from the cradle as has been necessary in prior arrangements, the shaving apparatus may be dried and then stored therein. To accomplish this, the cradle is configured as a cleaning dish, a drying dish and/or a storage device and/or is provided in the cleaning device.

Further it is advantageous that the cradle or the shaving head are adapted to be supplied with cleaning fluid from the cleaning fluid container by means of the feed pump for a predetermined period of time, and that the cradle is subsequently available for the drying process without this involving the need for the shaving apparatus to be removed from the cleaning device.

It is another advantage that the cradle for receiving the shaving head is associated with an air-drying device adapted to be activated by an electric arrangement after the cleaning fluid has been drained from the cradle to the cleaning fluid container.

It is a still further advantage that the cradle is arranged outside the cleaning fluid and/or above the fluid level of the cleaning fluid held in the cleaning fluid container, and that at least the cradle and/or the cleaning fluid container are permanently open towards the outside, that is, to atmosphere. This enables the shaving apparatus to be inserted in the cradle without any effort and to be withdrawn therefrom without the need to utilize any parts closing the cradle. Moreover, this arrangement obviates the provision of an elaborate seal, enabling an economical cleaning device to be built affording substantially greater operating comfort than the cleaning system known in the art.

It is also advantageous that the cradle is provided with an overflow device and/or at least one outlet port through which the cleaning fluid can be conveyed to a cleaning fluid container, and that the area of cross-section of the outlet port in the cradle is dimensioned such that during the cleaning operation the amount of cleaning fluid drained through the outlet port is smaller than the amount of cleaning fluid supplied to the cradle through the feed pump. The overflow device which constitutes part of the cradle ensures that the cradle is at all times filled with a sufficient amount of cleaning fluid, remaining filled to the upper rim area of the cradle.

The cleaning function is aided by the oscillatory motion of the shaving head. As a result, temporary cavitation and also a mechanically or fluidically induced cleaning effect may be accomplished during the cleaning operation. By virtue of the oscillatory motion of the shaving head, cleaning fluid is caused to splash up, thus penetrating into all areas of the shaving head. As this occurs, part of the agitated fluid is allowed to be drained over the overflow device to be circulated back to the cleaning circuit, without the fluid reaching the outside.

When the feed pump delivering the cleaning fluid is turned off following termination of the cleaning operation, the cleaning fluid is immediately allowed to be drained through the outlet port provided in the cradle, enabling the drying operation for the shaving head to be started automatically.

Finally, according to a preferred embodiment of the present invention, a hose member permeable to the cleaning fluid is provided between the overflow device and the cleaning fluid container. The hose member reliably prevents hair dust from being conveyed to the cleaning fluid container and settling therein.

It is of particular importance to the present invention that a collecting dish is provided underneath the cradle conformed to the shape of the shaving head, which dish includes a drain opening, and that the filter means is comprised of a connection means to which the hose member permeable to fluid flow into the reservoir is fitted, the hose member being immersed in the cleaning fluid held in the cleaning fluid container.

As mentioned in the foregoing, the overflow device ensures that the cradle is at all times filled with cleaning fluid to the upper rim. Excess cleaning fluid can then be readily directed over the overflow device into the collecting dish provided underneath the cradle, which dish is in communication with the corresponding connection means. The connection means with the hose member fitted thereto invariably extends into the cleaning fluid contained in the cleaning fluid container. The hose member ensures that dirt does not collect in the cleaning fluid container and that at the beginning of the cleaning operation the pump can draw fluid from the container through the hose member.

Advantageously, the connection means is directly or indirectly connected to the suction side of the feed pump, its delivery side being in communication with a filter means through a conduit. When the pump is activated to start the cleaning operation, it does not draw air because the hose is at all times immersed in the fluid. Further it is advantageous that the filter means is connected to the cradle by means of an outlet connection means, and that an outlet port provided in the cradle is connected to the cleaning fluid container.

The cleaning fluid drawn by the feed pump from the cleaning fluid container is passed, as mentioned in the foregoing, through the connection means and the hose member to the suction side of the feed pump, and onwards through the delivery side and, where applicable, a further conduit, to the filter means which in turn is in communication with the cradle of the cleaning device. This closes the cleaning circuit for the cleaning fluid.

Still further, it is advantageous that the shaving apparatus is insertable into a supporting structure configured as a bracket or a wall mount and is mechanically and/or electrically interlockable by a switching means. By virtue of the advantageous configuration of this supporting structure, the shaving apparatus can be stored in the cleaning device in a perfect and well protected manner for an indefinite length of time, and for the cleaning operation it can be locked in place in its supporting structure by mechanical as well as electrical means, so that upon actuation of the switching means the shaving apparatus discontinues being removable until the cleaning and drying operations are completed and the shaving apparatus is needed for a shave. This is made possible by the advantageous separate arrangement of cradle and cleaning fluid container, because cleaning fluid cannot be retained in the cradle upon termination of the cleaning action.

In this connection it is advantageous that the switching means for mechanically and/or electrically interlocking the shaving apparatus is movable against the force of a spring from an "Off" position or unlockable position into at least one position interlocking the shaving apparatus, which also corresponds to the "On" position for electrically activating the shaving apparatus, and that the "On" position for electrically activating the shaving apparatus also serves for activation of the cleaning device.

Moreover, it is advantageous that the "On" position serves to electrically activate a charge control means, in particular a charge control means of a charging device in the shaving apparatus, and that the switching means is adapted to be connected to an electric control circuit which activates the cleaning device for a predetermined or programmable period of time, and which additionally activates the drying device of the shaving apparatus for a predetermined or programmable period of time after the shaving head has been cleaned.

When the cleaning and drying operation of the shaving head of the shaving apparatus is completed, a suitable timing element cancels the mechanical or electrical interlock of the shaving apparatus so that it can be removed from the supporting structure of the cleaning device if so desired. However, as long as it is desired to utilize the shaving apparatus as either a cord or a cordless appliance, it may remain stored in the cradle configured to advantage since it remains dry on completion of the cleaning cycle.

The cleaning device is designed for use with all electric shaving apparatus. For example, when a shaving apparatus operated with accumulator current is received in the mount, it may be equally stored therein and be recharged should the accumulator have become discharged during prolonged periods of non-use.

The advantageous configuration of the cleaning device in combination with a storage device results in a very compact appliance enabling the shaving apparatus to be cleaned and dried in a very short period of time, to be recharged, where applicable, and to be stored, if so desired.

To this effect it is advantageous that the electric control circuit activatable by the switching means is adapted to be energized for the control of the various operating stages of the cleaning device, is adapted to be de-energized for the control of the cleaning and drying cycle, cancels the electrical and/or mechanical interlock and/or terminates the charging cycle of the shaving apparatus.

In a further feature of the present invention, it is advantageous that the bracket, the wall mount, the cleaning device, the cleaning fluid container and/or the drying device or the impeller form an integral unit adapted to receive the shaving apparatus.

An additional possibility according to a further feature of the device of the present invention is afforded in that the bracket combines with its vertically extending leg, a vertically extending leg of the wall mount and the cradle to form a U-shaped casing when viewing the device from the side.

An optimum cleaning operation is accomplished if cleaning and maintenance of the shaving apparatus are performed by proceeding in accordance with the following steps:

(a) Setting a switching means from a first to a further position mechanically and/or electrically interlocks the shaving apparatus in the casing of the cleaning device for the full length of the cleaning and drying cycle;

(b) setting a switching means from a first to a second or third position starts the cleaning cycle of the shaving head of the shaving apparatus for either a brief or an intensive cleaning function, the inner cutter of the shaving head is activated, and the feed pump for supplying cleaning fluid to the shaving head is turned on for a first period of time of between 3 and 20 seconds, during which time the cleaning fluid is continuously conveyed to the cradle through a filter means as the cleaning cycle proceeds;

(c) following the first period of time of between 3 and 20 seconds, the feed pump is turned off, and the cleaning fluid is passed from the cradle to a cleaning fluid container;

(d) oscillation of the inner cutter of the shaving head is continued for a second period of time of between 1 and 30 seconds which is the drying and vibrating cycle;

(e) the drying device and/or the heating means of the drying device is turned on for the duration of the second and/or the third period of between 3 and 30 minutes, air being supplied to the shaving head to effect a drying action;

(f) following expiration of the three or four periods of time or following the drying cycle or the last cycle of operation, the drying device and/or the heating means of the drying device are turned off, and the electrical and/or mechanical interlock of the shaving apparatus is canceled.

The period of time indicated under (c) relates to a normal cleaning operation, while it is understood that a longer period of time is required for an intensive cleaning action.

It is further advantageous that the shaving apparatus is recharged by setting a switching means from a first to a second or third position.

Further advantages and details of the present invention will become apparent from the subsequent description and the accompanying drawings illustrating some preferred embodiments.

An embodiment of the present invention is shown in the Figures by way of example without being limited to this particular embodiment. In the drawings, FIG. 1 is a partial sectional view of a cleaning device in which a shaving apparatus is received;

FIG. 7 is a view of the cleaning fluid container configured as a cartridge, with an integrally formed filter means according to FIG. 6;

FIG. 8 is a partial view of the fastening structure of the lower part of the filter means in the casing of the cleaning fluid container;

FIG. 9 is a top plan view of the cleaning fluid container of FIG. 7 configured as a cartridge and including locating means;

Figure 1:
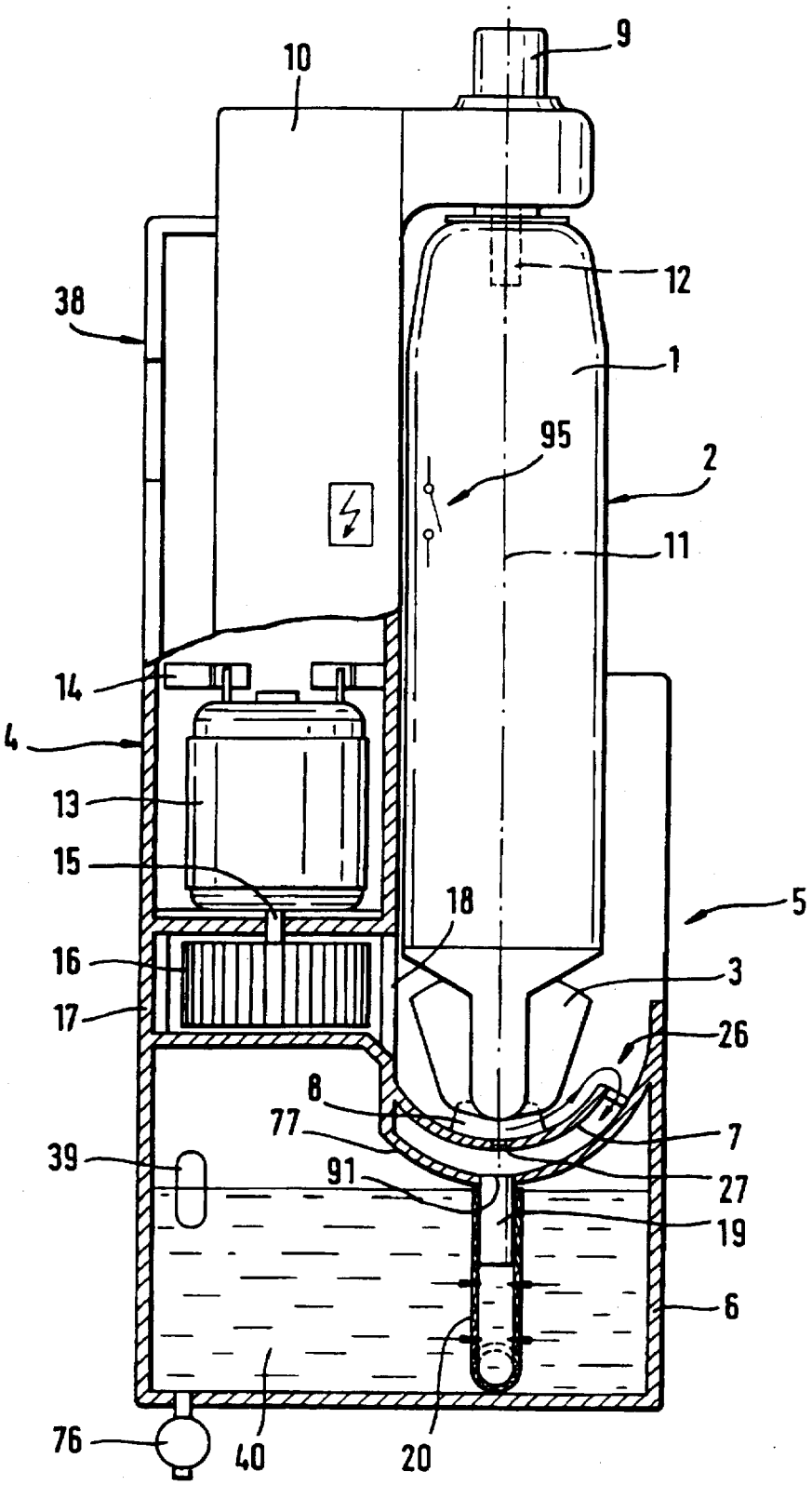

Referring now to FIG. 1 of the drawings, there is shown an electric shaving apparatus or shaver 1 including a housing 2 and a shaving head 3 with an inner cutter, not shown in the drawings, the shaving head being pivotal relative to the housing 2 from the mid-position shown into opposite directions about a pivot axis.

The shaving apparatus 1 is received in a casing 4 of a cleaning device 5. The cleaning device 5 is comprised of a cleaning fluid container 6 containing a fat-dissolving cleaning fluid 40 and of a cradle structure 7 configured as a cleaning dish, a drying dish and a storage means. Being slightly dished inwardly, the cradle 7 conforms approximately to the outer contour of the shaving head 3 of the shaving apparatus 1, and it holds only as much cleaning fluid as is necessary for the respective cleaning operation.

The cleaning device 5, in particular the wet portion thereof, that is, the cradle 7, is configured as a cleaning system open to atmosphere, whilst the cleaning fluid container 6 may be either open or, as will be subsequently described with reference to an embodiment (FIG. 7), partially or entirely closed.

With its shaving head 3 in an inverted position, the shaving apparatus 1 is seated in the upwardly open cradle 7 configured as wet portion. During the cleaning cycle, cleaning fluid is continuously flushed through the cradle 7. At a particular level of contamination, the cleaning fluid may be drained through a closable conduit 76, and fresh fluid may be substituted.

The cradle 7 includes an overflow device 26 which prevents the cleaning fluid in the cradle 7 from exceeding a defined level and ensures that only the shaving head 3 or the lower part of the shaving head is immersed in cleaning fluid. Further, the bottom of the cradle 7 includes an outlet port 27 allowing the cleaning fluid with hair particles to be completely drained into the cleaning fluid container 6 through a hose member 20 permeable to fluid after the cleaning cycle is completed.

However, the outlet port 27 is dimensioned such that the cradle 7, when supplied with cleaning fluid from a pump 23 described in the following, rather than being allowed to run empty, is at all times kept filled to the rim, with excess cleaning fluid being mainly discharged over the rim of the cradle 7 in the direction of the arrow, collecting in the cleaning fluid container 6 underneath. In this manner, a sufficient amount of cleaning fluid is at all times available for the cleaning cycle. Arranged below the cradle 7 is a collecting dish 77 of an equally concave configuration conforming to the cradle 7, which dish is connected to the overflow device 26 or is a part of said overflow device 26. As becomes apparent from FIG. 1, the shaving head 3 rests in the cradle 7 by means of elastic supporting means 8 serving to avoid damage to the shaving apparatus as it is placed down in the cradle 7 and to cushion the shaving apparatus during vibration.

Further, by means of a switching means 9 which may be configured as a start button and is mounted in a bracket 10, the shaving apparatus 1 (FIG. 1) is mechanically and/or electrically interlocked. The bracket 10 is fixedly connected with a wall mount 38 enabling the complete cleaning device 5 with the shaving apparatus 1 to be mounted on a wall or, alternatively, to be kept in a stand for storage.

The wall mount 38 and the bracket 10 open to the right when viewing FIG. 1 as well as the cradle 7 with the cleaning fluid container 6 combine to form the cleaning device 5 which is a unit of U-shaped cross-section. The shaving apparatus 1 may continue to be stored in the wall mount 38 also upon completion of the cleaning cycle, because all cleaning fluid is drained from the wet portion or the cradle 7 after cleaning is terminated. The shaving apparatus 1 may also remain in the wall mount 38 for recharging. The cleaning device 5 is suitable for utilization with any type of electric shaving apparatus.

The switching means 9 is arranged so as to be displaceable in the direction of a longitudinal center line 11 of the shaving apparatus 1 and is connected, by means of an electric control device 29, to timing elements serving to control the cleaning cycle.

The switching means 9 has at its lower end two relatively spaced contact means 12 for establishing contact with or supplying current to the shaving apparatus 1, which contact means, on depression of the switching means 9, cooperate with corresponding contact means of the shaving apparatus 1. In this manner, the shaving apparatus 1 can be set in operation when the switching means 9 is depressed and a power cord, not shown, of the cleaning device 5 is connected to an electrical outlet.

Adjacent to the shaving apparatus 1 in the casing 4 of the cleaning device 5 is an electric motor 13 having two electrical contact lugs 14 for connection to the electricity supply. Provided at the lower end of the electric motor 13 is a motor output shaft 15 on which an impeller or impeller wheel 16 is arranged serving in particular for drying the cleaned shaving head 3 of the shaving apparatus 1 following termination of the cleaning cycle of the shaving head 3 described in more detail in the following. The impeller 16 sits in an impeller casing 17 communicating through an opening 18 with the space above the cradle 7, and it directs a continuous stream of hot air heated by a heating means, not shown in the drawings, against the shaving head 3 to effect a drying action following the cleaning operation.

As mentioned in the foregoing, the bracket 10 combines with its vertically extending leg, a vertically extending leg of the wall mount 38 and the cradle 7 to form the U-shaped casing 4 when viewing the cleaning device 5 from the side, in which casing the shaving apparatus 1 is readily insertable from the side by imparting to it a lateral tilting motion, to be kept therein for storage.

According to FIG. 1, the cradle 7 extends into the cleaning fluid container 6 which is filled with cleaning fluid to two thirds, maximum. Adjoining the underside of the cradle 7 is a connection means 19 to which the porous hose member 20 is fitted which is permeable to the fluid entering the container 6 and prevents contaminants from penetrating into the cleaning fluid container 6 and settling at the bottom thereof. The connection means 19 may be of a porous configuration like the hose member 20, allowing the passage of fluid therethrough to the container 6.

The connection means 19 is fixedly connected with an opening 91, the collecting dish 77 and the overflow device 26.

The cleaning fluid container 6 may be provided with a fluid level indicating means 39 enabling the amount of spent cleaning fluid to be monitored at all times. According to FIG. 1, the fluid level indicating means 39 may be configured as a small viewing window. In lieu of the viewing window, it is also possible to provide an electronic indicating means comprising suitable sensors indicating the fluid level or also the degree of contamination of the cleaning fluid 40. For example, when the fluid is contaminated to a degree which must not be exceeded, this condition may be indicated by the sensors, thus informing the operator of the need to drain the cleaning fluid 40 through the conduit 76 for replacement. Depending on the embodiment, the sensors may also be used for de-activating the electric control electrodes, thereby automatically interrupting the cleaning cycle and compelling the operator to replace the cleaning fluid.

Figure 2:
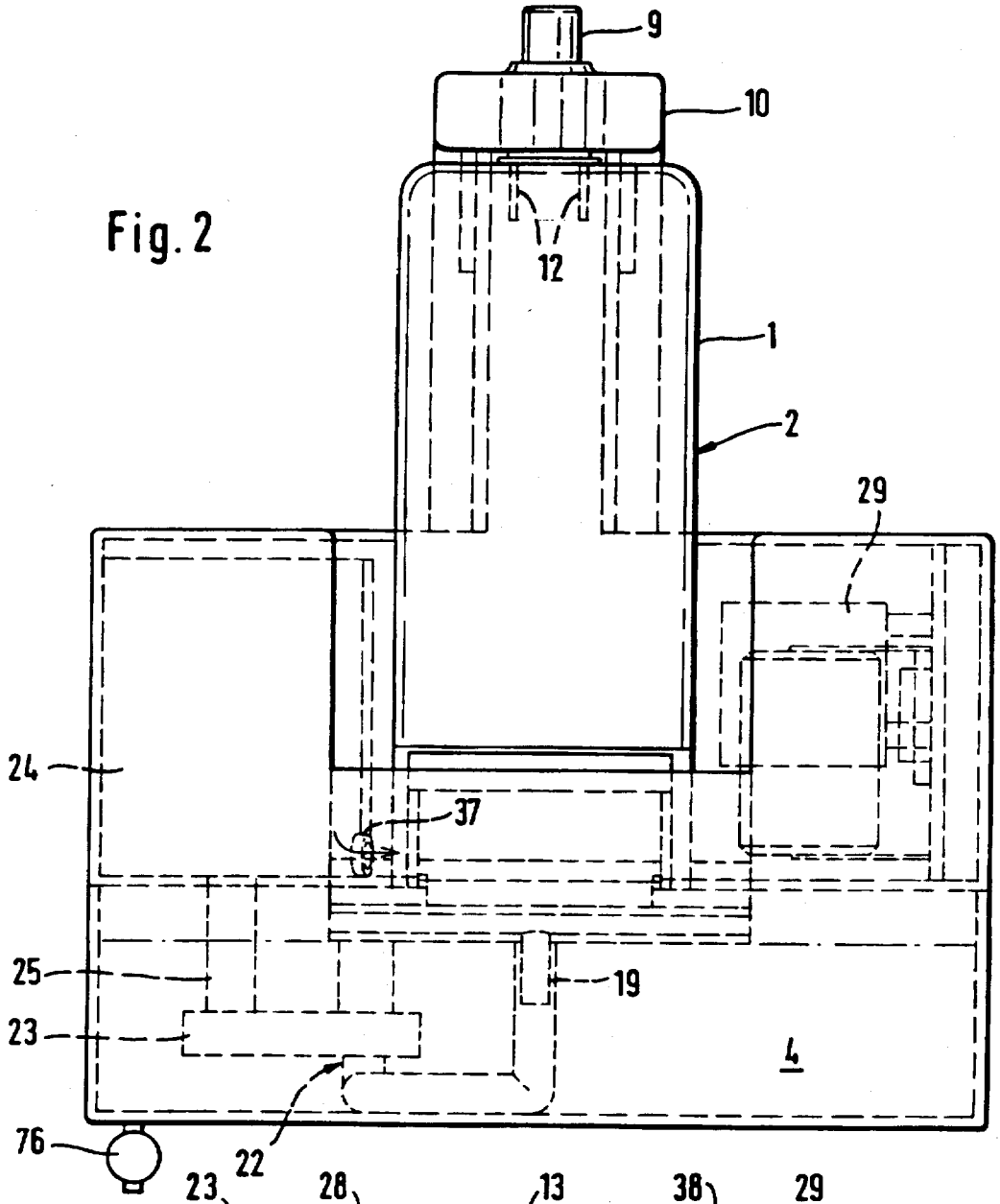
FIG. 2 is a front view of the cleaning device of FIG. 1.

As becomes apparent from FIG. 2, the connection means 19 is in communication with an intake connection means 22 of the feed pump 23 which delivers the cleaning fluid to a filter means 24 through a conduit 25.

To perform the cleaning cycle, the shaving apparatus 1 to be cleaned is introduced into the cleaning device 5 from the side and subsequently locked in place by the switching means 9 which, initially occupying its upper position, is for this purpose displaced downwards into a second position until the two contact lugs engage the contact means 12 provided in the shaving apparatus 1. The shaving apparatus 1 is thereby interlocked electrically and mechanically, allowing the operator to withdraw the shaving apparatus 1 not until after the cleaning and the subsequent drying cycle have been completed, canceling the interlock.

Figure 4:
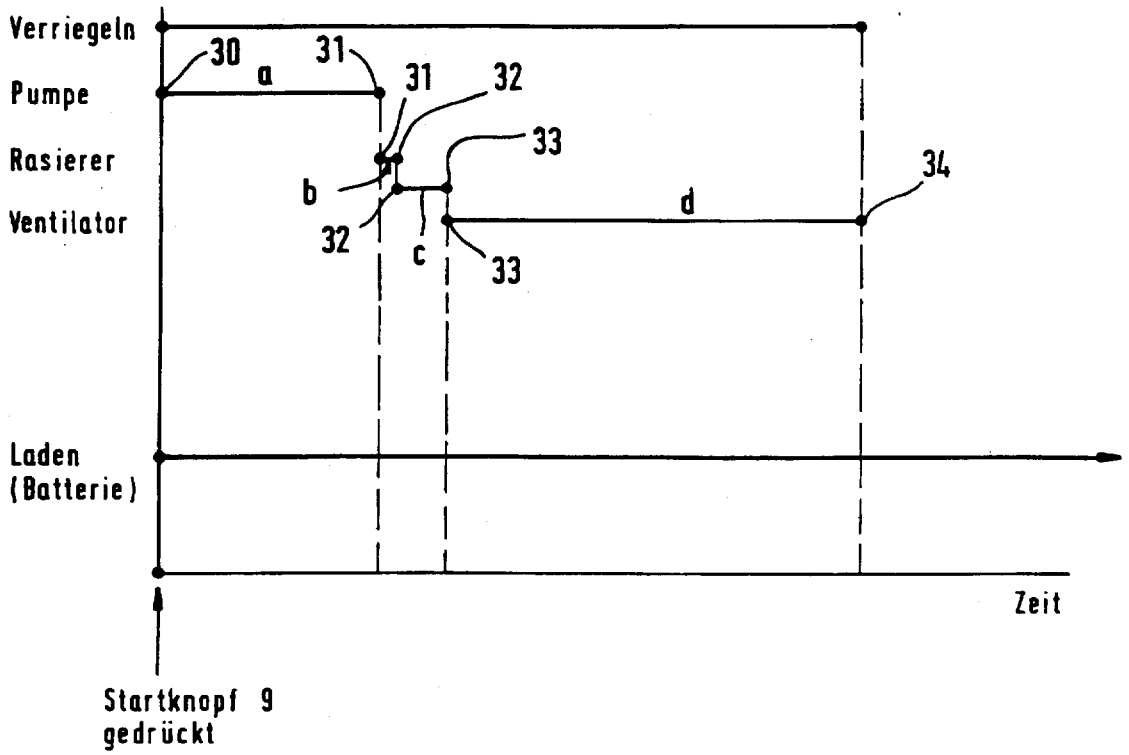
FIG. 4 is a schematic diagram depicting the individual cleaning stages as a function of time.

Operation of the switching means 9 causes the feed pump 23 to be driven which then delivers cleaning fluid 40 to the cradle 7 and to the shaving head 3 for a predetermined period of time, the fluid dislodging all of the hair dust 75 in the shaving head 3 (see segment 30 to 31 in FIG. 4).

The cleaning fluid with the hair dust then passes through the outlet port 27, the cradle 7 and the overflow device 26 to the hose member 20 permeable to the fluid flowing to the container 6, and onwards directly to the feed pump 23 and back to the filter means 24. As this occurs, some of the fluid will, of course, also flow to the cleaning fluid container 6 through the hose member 20. This has the advantage that the cleaning fluid with the complete hair dust 75 from the shaving apparatus 1 is delivered in concentrated form to the filter means 24 in which the cleaning fluid is completely cleaned. The hose member 20 thus ensures that hair particles can not enter the cleaning fluid container 6 through the hose member 20 and that hair dust is not allowed to settle in the cleaning fluid container 6.

The feed pump 23 is permanently connected to the cleaning fluid container 6 through the hose member 20 permeable to the fluid, as a result of which fluid is supplied thereto at all times without air being drawn in, not even when the pump is turned on at the start of a cleaning cycle and the piping has drained its fluid to the cleaning fluid container 6. The cleaning fluid cleaned in the filter means 24 is conveyed to the cradle 7 through an outlet connection means 37 of the filter means 24.

Figure 3:
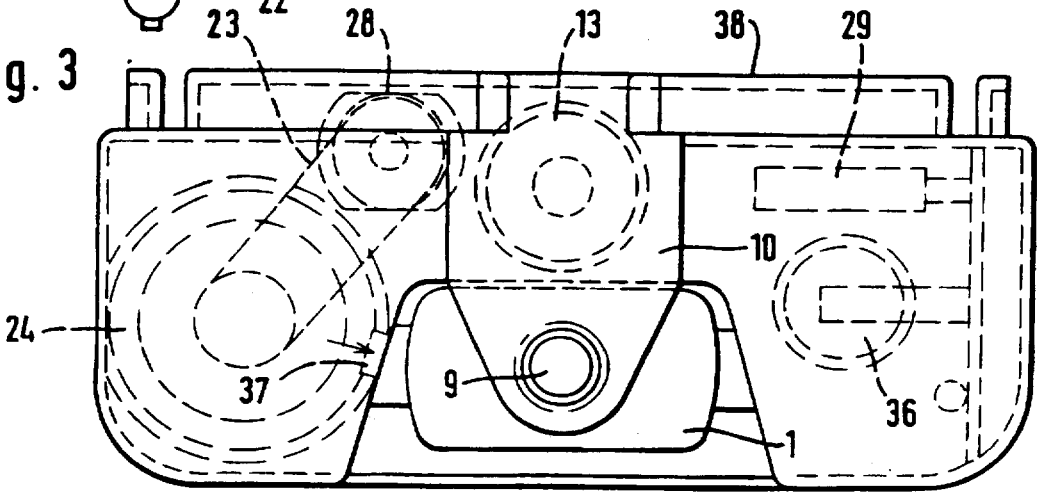
FIG. 3 is a top plan view of the cleaning device of FIG. 2.

FIG. 3 shows schematically in top plan view the arrangement of the essential parts of the cleaning device 5 including, for example, the feed pump 23 and an associated motor 28 which is turned on by the switching means 9. When viewing this Figure, there is shown to the right of the bracket 10 supporting the shaving apparatus 1 the electric control device 29 including timing elements, not shown, for controlling the individual stages of the cleaning cycle. Further arranged in the area of the bracket 10 is the motor 28 adapted to drive directly the impeller 16 which is operatively associated with a heating means for heating the air used for drying the shaving apparatus 1.

To be able to step the line voltage down to the requisite operating voltage, the cleaning device 5 is provided with a transformer 36.

FIG. 4 is a schematic diagram depicting the individual stages of the cleaning cycle as a function of time. The individual segments between points 30 to 34 show the individual cyclic stages of the cleaning device 5.

When, as initially mentioned, the switching means 9 is actuated at point 30 in FIG. 4 by downward displacement (control button 9 depressed), this has the concurrent effect of causing oscillation of the inner cutters, not shown, of the shaving apparatus 1, thereby producing in the shaving head 3 a flow with partially occurring cavitation which dislodges hair dust and grease particles from the inner cutters of the shaving head completely. Owing to the fluid being agitated, the fluid level in the cradle 7 is temporarily increased, while at the same time splashes are produced in the area of the shaving head 3 performing a thorough cleaning function on the shaving head 3 as well as the inner cutters although the level of the cleaning fluid reaches only part of the shaving head 3. Depending on the type of cleaning fluid utilized and the degree of contamination of the shaving head, the cleaning action lasts between 3 and 60 seconds (see segment a between points 30 and 31). When the shaving apparatus 1 is not cleaned at regular intervals, the cleaning cycle (segment a between points 30 and 31) is extended correspondingly. To accomplish this, the cleaning device may be provided with a two-step switch not shown in the drawings, the first step being intended for a regular cleaning cycle and the second step for an intensive cleaning cycle.

On completion of the cleaning cycle, the feed pump 23 is automatically turned off at point 31 (end of the cleaning cycle) of FIG. 4. This then enables the cleaning fluid to be drained completely through the outlet port 27, causing the wet portion or the cradle 7 to be evacuated. The level in the cleaning fluid container 6 rises a small amount. The outlet port 27 may also be closable by a valve, not shown in the drawings, which opens automatically when point 31 is reached. After about 30 seconds, the cradle 7 is completely emptied (see segment b between points 31 and 32, draining the cradle 7).

After the cradle 7 is drained at point 32, the shaving head 3 continues oscillating for some time, shaking off any cleaning fluid that may still adhere to the shaving head 3. After the set time has elapsed, the shaving apparatus 1 is turned off, and the inner cutter of the shaving head 3 stops moving at point 33 (end of the vibratory cycle). The turn-on and turn-off operations are accomplished by means of an electromagnetic reed switch 95 shown schematically which, according to FIG. 1, is accommodated in the housing 2 of the shaving apparatus 1. When the reed switch 95 is opened automatically on completion of the vibratory cycle, operation of the shaving apparatus 1 is also discontinued, initiating at point 33 the drying cycle described in the following (segment d).

Being automatically inserted in the circuit at point 33, the impeller 16 is turned on with or without heating means and driven by the electric motor 13, thus delivering dry air to the shaving head 3 for a predetermined period of time (see segment d between points 33 and 34). Then the interlock of the shaving apparatus 1 is deactivated at the control button 9.

Figure 6:
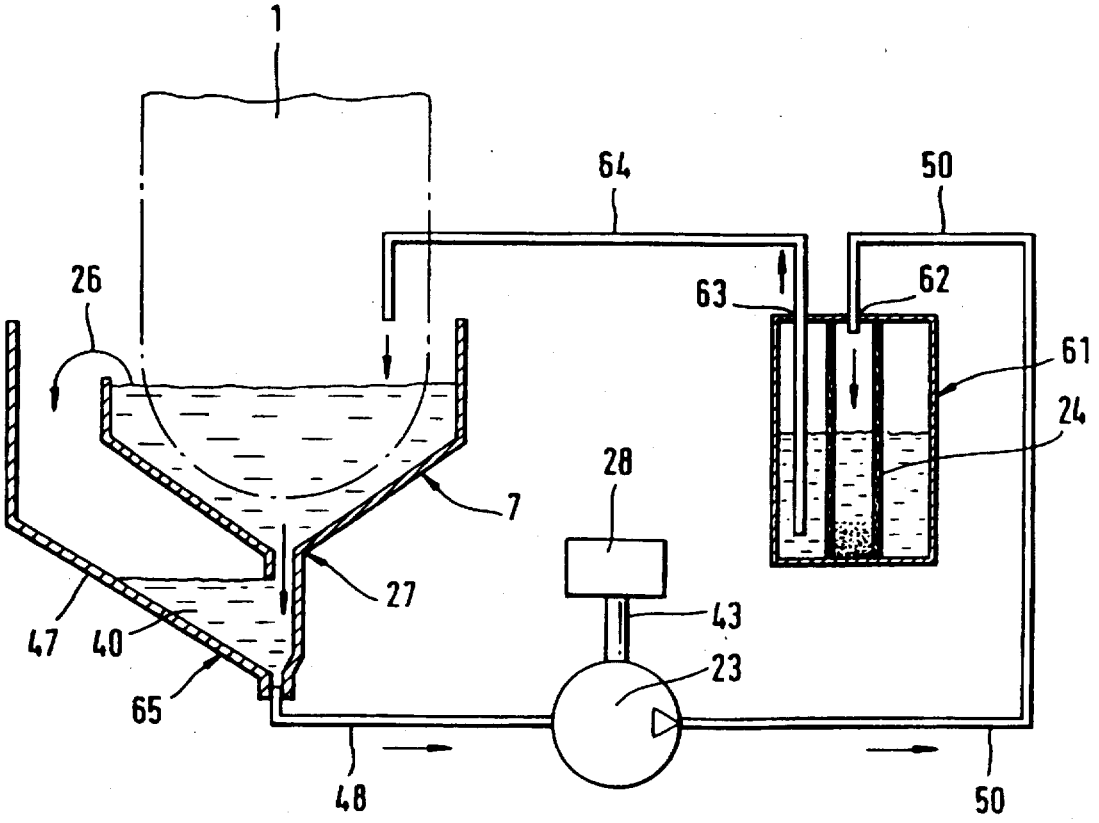
FIG. 6 is a schematic representation of the fluid circuit of the cleaning device, in particular between the cradle structure, the filter means and the cleaning fluid container configured as a cartridge.

FIG. 6 shows schematically the fluid circuit of the cleaning fluid 40. The cleaning device 5 incorporates the cradle 7 in which the shaving apparatus 1 is inserted in an inverted position so that the shaving head 3 is at least partially immersed in the cleaning fluid.

The cleaning device 5 further incorporates (FIG. 6) the feed pump 23 and the motor 28 connected to a supply of electricity through electrical lines and activatable by the switching means 9. The feed pump 23 is driven by the motor 28 adapted to bear against supporting means in the casing 4 of the cleaning device 5.

The shaft 43 projecting from the motor 28 drives the pump 23 provided in a pump casing.

As becomes further apparent from FIG. 6, a collecting reservoir 65 for receiving the cleaning fluid 40 is provided which is smaller than the cleaning fluid container 6 of the first embodiment. The collecting reservoir 65 has a bottom 47 arranged at an inclination, for example, at an angle of between 20° and 40° to prevent hair particles from collecting at the bottom 47. An intake connection means 48 of the feed pump 23 is attached to the lower area of the bottom 47, so that the cleaning fluid discharged over the overflow device 26 is conveyed, through the collecting reservoir 65, the intake connection means 48 of the feed pump 23 as well as a conduit 10, directly to the filter means 24 illustrated in greater detail in FIGS. 7, 8 and 9. The hair dust 75 collecting in the reservoir 65 is agitated in the cleaning fluid such that it is fed to the filter 24 and retained thereby, rather than being allowed to settle at the bottom 47 of the collecting reservoir 65. The filtered cleaning fluid is then circulated back to the cradle 7 through a conduit 64.

A cleaning fluid container 61 which is configured as a cartridge in FIG. 6 is provided with an outlet port 63 communicating with the cradle 7 through the conduit 64. In this manner, the cleaning circuit is closed.

According to this embodiment (FIG. 6), the switching means 9 activates the feed pump 23 configured as a vane-type pump drawing air at the beginning of the cleaning cycle and forcing this air through the conduit 50 into the cleaning fluid container 61 so that the cleaning fluid flows from the cleaning fluid container 61 through the outlet port 63 and the conduit 64 to the drained cradle 7, refilling it until the cleaning fluid is discharged to the collecting reservoir 65 over the overflow device 26. Part of the fluid is continuously drained through the outlet port 27. Considering, however, that the feed pump 23 delivers more fluid to the cradle 7 than can be drained through the outlet port 27, it is ensured that during the cleaning cycle the cradle 7 remains filled with fluid to the level of the overflow device 26.

The container 61 inlet and outlet ports 62, 63 shown in FIG. 7 may also be provided at a bottom 67 of the container 61, enabling the container 61 to be connected to suitable conduits from above. It is thereby achieved that a permanent flow of cleaning fluid is delivered from the container 61 to the intake of the pump 23, causing the pump to be under permanent fluid pressure which ensures that the pump draws only cleaning fluid, rather than air, when put into operation.

The container 61 or cartridge shown in FIGS. 7 to 9 is comprised of a cylindrical can structure 101 having a bottom 67 and a lid 72 in which the inlet port 62 and the outlet port 63 as well as the filter means 24 are provided.

The lid 72 is sealed relative to the upper rim of the container 61 by hemming such as to prevent it from being pulled off the can structure 101. The conduit 50 arriving from the pump 23 is connected to the inlet port 62, while the conduit 64 leading to the cradle 7 is connected to the outlet port 63. Quick-release coupling members, not shown in the drawings, may be provided in the area of the inlet and outlet ports 62, 63 to allow ready replacement of the cleaning fluid container 61 when it is necessary to renew the cleaning fluid or when the filter means 24 provided in the cleaning fluid container 61 has become clogged.

The degree of contamination or the hair dust 75 retained in the filter means 24 may be determined by means of an indicating device not shown in the drawings. The indicating device may include a pressure sensor and a telltale light indicating the degree of contamination or the pressure status. When the filter means 24 is no longer usable, the cleaning fluid container 61 is detached from the conduits 50, 64, and a new one is substituted.

In the embodiment of FIGS. 7 to 9, the filter means 24 is configured as a cylindrical paper filter arranged coaxially in the casing 101.

According to FIG. 8, the filter means 24 is forced with a lower end 70 thereof into engagement with an annular groove 68 provided at the bottom 67 of the can structure 101 coaxially with the can structure 101. The annular groove 68 is comprised of two relatively spaced parallel annular walls or hem flanges 69, 71 projecting from the bottom 67 so that the lower end 70 of the filter means 24 is clampingly engaged within the annular groove 68. The filter means 24 forms a first chamber receiving the hair dust, while the remaining part of the casing forms a second chamber for holding cleaned fluid.

As becomes apparent from FIG. 9, the upper lid 72 of the can 101 of the container 61 includes four relatively spaced locating means 73 arranged in cross shape and serving to locate the filter means in coaxial alignment within the cleaning fluid container 61.

The lid 72 (FIGS. 7, 9) further includes a foil 74 which is pierced by the conduits 50, 64 as the container 61 is inserted in the casing 4, thereby establishing the coupling engagement with the inlet and outlet ports 62 and 63, respectively. Conveniently, the two conduits 50, 6 4 may be provided with a sharp edge or tip 103 at their respective ends to facilitate piercing of the foil sealing the ports 62, 63. It is also possible to seal the ports 62, 63 by means of a pull-off strap under which sealing members capable of being pierced may be provided into which the conduits 50, 64 are inserted.

Figure 11:
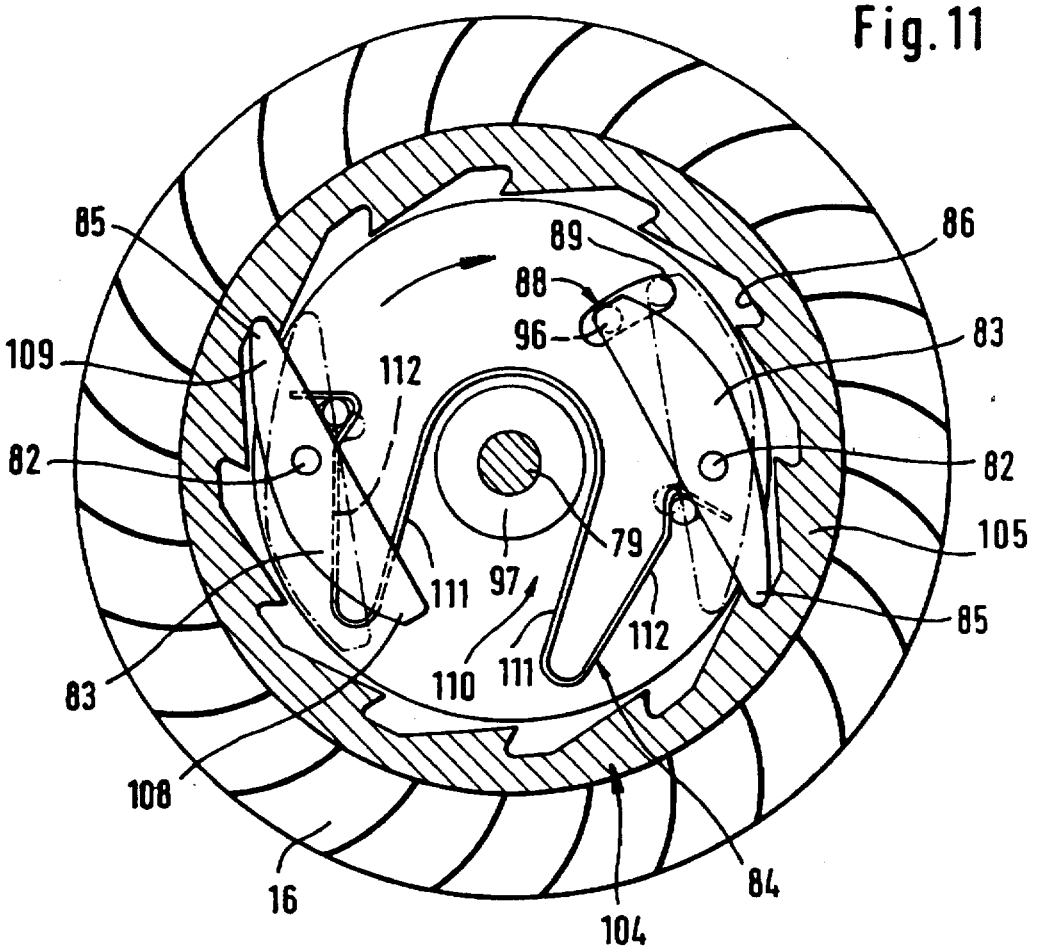
FIG. 11 is a sectional view taken along the line A—A of FIG. 10.
Figure 5:
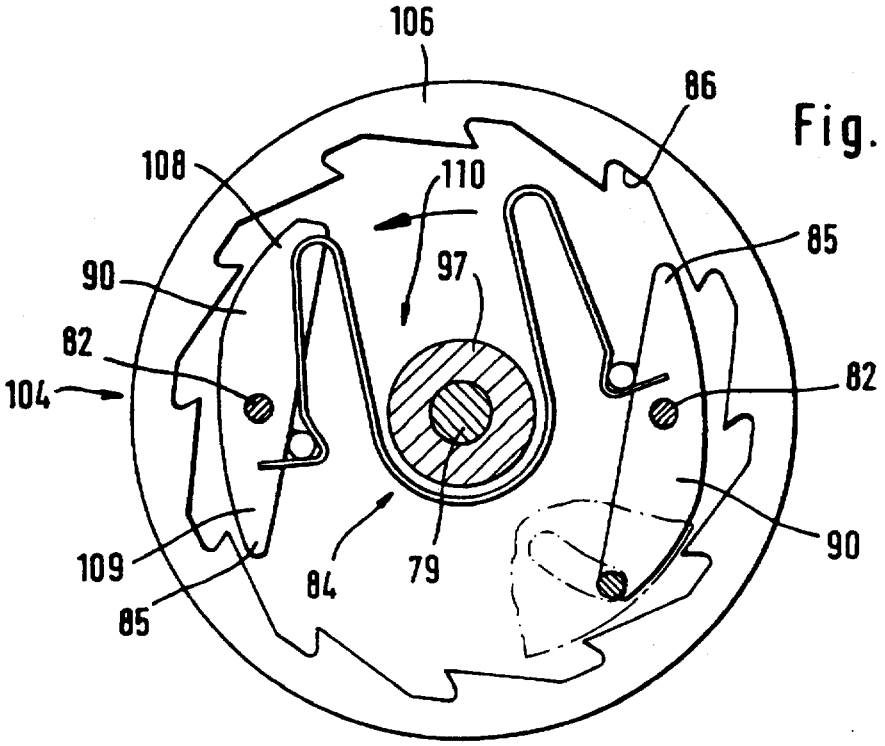
FIG. 5 is a sectional view taken along the line B—B of FIG. 10.
Figure 10:
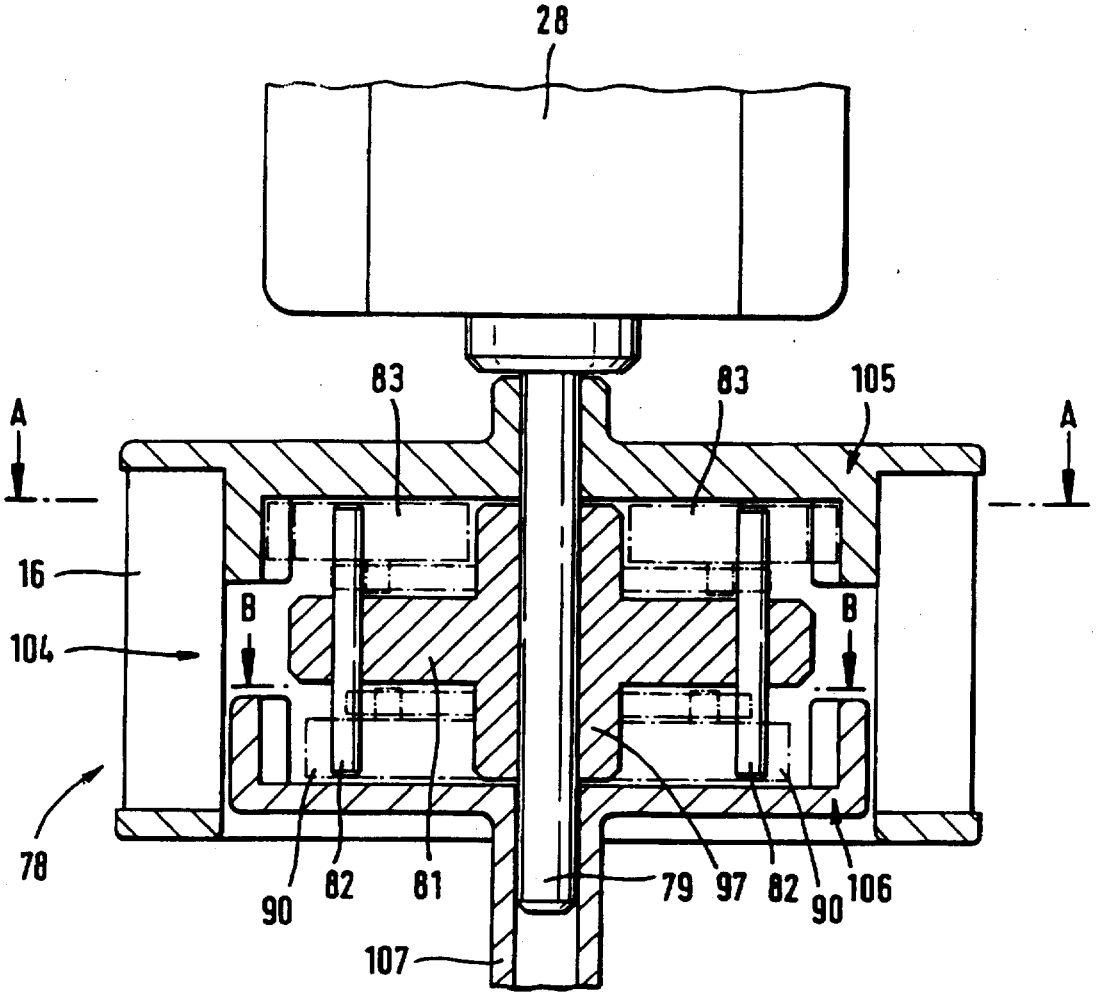
FIG. 10 is a sectional view of a drive mechanism for the impeller and the pump, including an overrunning device.

FIGS. 5, 10 and 11 illustrate a mechanism 78 for driving the impeller 16 and the feed pump 23. Since it is not desirable to drive the feed pump 23 and the impeller 16 at the same time, they may be driven selectively by the single motor 28. The drive mechanism 78 which also includes the motor 28 is provided with a device reversing the direction of rotation which includes one (FIG. 12) or, according to FIGS. 5 and 11, two over-running devices 104, one driving the impeller 16 in a clockwise direction, the other driving the feed pump 23 in a direction opposite thereto.

Figure 12:
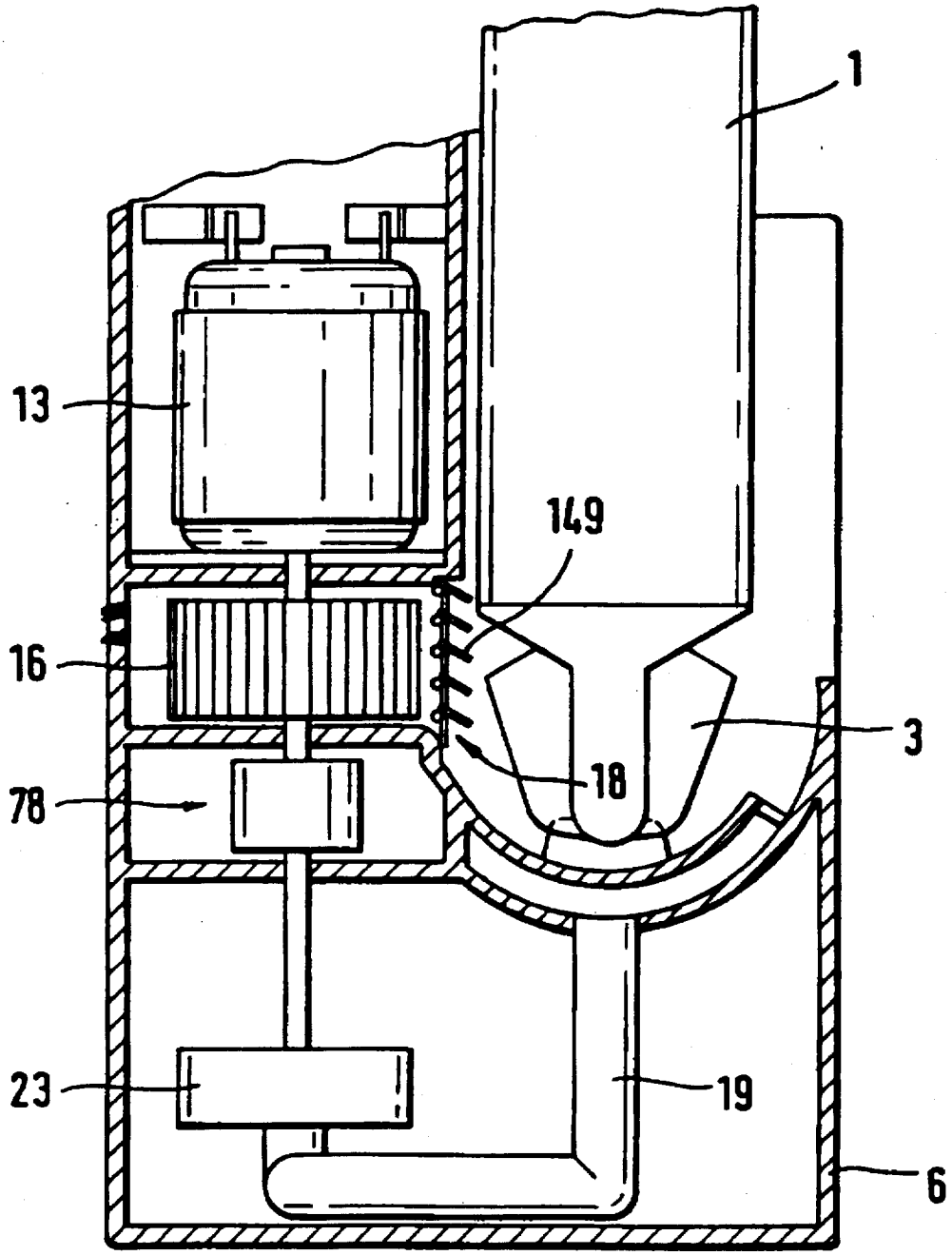
FIG. 12 is a view of a further embodiment of a drive mechanism for the pump and the drying device.

The device reversing the direction of rotation, together with the upper and the lower overrunning device 104, is seated on a motor output shaft 79 of the motor 28 on which also the impeller 16 is arranged. The overrunning device 104 may be provided with a clamp-type locking mechanism including for this purpose a one-way coupling with self-locking frictional engagement. Further, clamping rollers or clamping plates may be provided as coupling means. In the embodiment of FIGS. 11 and 12, the overrunning devices 104 are comprised of internal gear rings 105, 106 having an upper and a lower tooth flank 86. The two internal gear rings 105, 106 are mounted on the motor output shaft 79 so as to rotate freely. The motor output shaft 79 drives a driving flange 81 which includes two diametrically opposite pawl axles 82 receiving each an upper and a lower crescent-shaped pawl 83, 90. The pawls 83, 90 include each two lever arms 108, 109 of different length (FIG. 11), with the longer lever arm 108 being guided in a slotted hole 88 by means of a pin 96, while the other lever arm 109 bears against a spring 84. FIGS. 5 and 11 show each one slotted hole 88.

The pawl 83 (FIG. 11) is pivotal on the pawl axle 82 in the direction of the inner periphery of the impeller 16 between a position shown in solid lines and a position shown in broken lines by means of the spring 84 bent twice in V-shape. The spring 84 includes a U-shaped member 110 by means of which it is seated on a hub 97 of the driving flange 81. The U-shaped member 110 is formed of two legs 111 which, each in combination with a further adjoining leg 112, form a double V.

In the position illustrated in FIG. 11, the two pawls 83 have an outer end 85 thereof in engagement with the tooth flanks 86 of the gear ring 105 connected to the impeller 16, thus establishing a driving relationship, in a clockwise direction, of the motor 28 to the impeller 16. The legs 112 of the spring 84 urge, through an abutment means, the end 85 of the lever arm 108 into engagement with the tooth flank 86.

When the motor output shaft 79 is driven in a counter-clockwise direction, the pawls 83 are first urged outwardly by the tooth flanks 86 and then, at a minimum rotational frequency, are pivoted on the pawl axle 82 outwardly in a clockwise direction in opposition to the action of the spring 84 owing to their eccentric arrangement on the pawl axle 82, until they engage a stop 89 of the slotted hole 88. This is accomplished in that the weight component of the lever arm 108 is greater than that of the other lever arm 109 of the pawl 83 relative to the pawl axle 82. As a result, the impeller 16 is disengaged from the motor output shaft 79. This position is maintained until the centrifugal moment has diminished due to a reduced rotational frequency to a level at which the spring moment prevails and the pawls 83 return to their engaged positions according to FIG. 11 (see the position of pawl 83 shown in solid lines).

By driving the motor output shaft 79 in a manner similar to the mode of operation of FIG. 11, yet in a counterclockwise direction, two further pawls 90 arranged below the driving flange 81 are then equally pivoted on the pawl axles 82 by means of the spring 84, their ends 85 engaging the tooth flanks 86, so that the pump 23 is operated by the same motor 28 and by a hollow shaft 107 disposed on the motor output shaft 79, whereas the two upper pawls 83 are maintained disengaged. At the beginning of the cleaning operation, only the pump 23 is driven according to FIG. 11, and the impeller 16 is released according to FIG. 5.

The two lower pawls 90 do not leave their engaged positions, thereby canceling the driving relationship of the motor 28 to the feed pump 23, until the direction of rotation of the motor 28 is changed. Because the outer ends of the pawls 83, 90 do not slip over the tooth flanks 86, noise and wear are prevented from occurring with the pawls 83, 90 running freely.

Owing to the advantageous driving relationship for selectively driving the feed pump 23 and the impeller 16, the requirement of having to provide a second drive motor for driving feed pump 23 and impeller 16 separately is obviated, so that cost savings may be realized.

The motor 28 and the impeller 16 as well as the pump 23 not shown in FIGS. 5, 10 and 11 and, if desired, the cleaning fluid container 61 may be arranged vertically on a common axis, which enables the number of gear parts between the motor 28, the pump 23 and the impeller 16 to be reduced to a minimum and, in consequence, allows the casing 4 of the cleaning device 5 to be built to smaller dimensions (see FIG. 12).

A further embodiment of a drive mechanism for the pump 23 and the drying device incorporating the impeller 16 is illustrated in FIG. 12.

In this embodiment, an overrunning arrangement 78 similar to the overrunning device of FIG. 11 comprises only two pawls 83 or some other coupling means. The coupling means establish a driving relationship between the motor 13 and the pump 23 or prevent the pump 23 from following the motor 13 in rotation when its direction of rotation is reversed. It will be understood that an overrunning arrangement configured in a manner different from the one shown in FIG. 11 may also be utilized.

When the overrunning arrangement establishes a driving connection between the motor 13—rotating, for example, in a counterclockwise direction—and the pump 23, the pump 23 is driven jointly with the impeller 16, and the pump 23 is in a position to direct cleaning fluid to the cradle 7.

The impeller 16 is prevented from drawing air from the cradle 7 because a louvered shutter 149 provided in the opening 18 remains closed as a result of the vacuum produced by the impeller 16.

Because of the very simple configuration of the overrunning arrangement, the electric motor 13 invariably drives the impeller 16 in either direction, so that with the motor 13 driven in a clockwise direction the air stream produced by the impeller 16 opens the louvered shutter 149 provided in the opening 18, feeding air to the shaving head 3 for drying.

When the motor 13 is driven in a counterclockwise direction, the stream of air produced by the then equally driven impeller 16 generates a vacuum in the area of the opening 18, causing the louvered shutter 149 to be closed again or to remain closed.

I claim:

1. A cleaning device comprising:

a cradle structure including a concave surface for receiving a shaving head of a shaving apparatus, a cleaning fluid container, said cradle structure including an outlet port connecting the cradle structure with the cleaning fluid container, said outlet port allowing hair to drain from said cradle structure, and a feed device for feeding cleaning fluid from said cleaning fluid container to said cradle structure, said cradle structure being arranged above a fluid level of the cleaning fluid in said cleaning fluid container during the feeding of said cleaning fluid to said cradle structure.

2. A device as claimed in claim 1, wherein a cross-sectional area of the outlet port is dimensioned such that during the cleaning operation the amount of cleaning fluid drained through the outlet port is smaller than the amount of cleaning fluid supplied to the cradle structure by the feeding device.

3. A device as claimed in claim 1, further comprising a collecting dish and a filter, said collecting dish being positioned underneath the cradle structure and including an outlet opening connecting with the filter.

4. A device as claimed in claim 1, further comprising a filter connected to an inlet of the cradle structure.

5. A device as claimed in claim 1 further comprising an overflow device connecting the cradle structure with the cleaning fluid container.

6. A device as claimed in claim 5, further comprising a hose member permeable to the cleaning fluid provided between the overflow device and the cleaning fluid container.

7. A device as claimed in claim 1, wherein the cleaning fluid container is permanently open to atmosphere.

8. A device as claimed in claim 1, further comprising a motor for driving the feed device.

9. A cleaning device comprising:

a cradle structure adapted to receive a shaving head of a shaving apparatus, a cleaning fluid container, a feed device for feeding cleaning fluid from said cleaning fluid container to said cradle structure, said cradle structure being arranged above a fluid level of the cleaning fluid in said cleaning fluid container during the feeding of said cleaning fluid to said cradle structure, and an electric arrangement for temporarily operating the shaving head of the shaving apparatus and the feed device.

10. A device as claimed in claim 9, further comprising a drying device, the drying device being associated with the cradle structure and adapted to be activated by the electric arrangement after the cleaning fluid has been drained from the cradle structure.

11. A cleaning device comprising:

a cradle structure adapted to receive a shaving head of a shaving apparatus, a cleaning fluid container, a feed device for feeding cleaning fluid from said cleaning fluid container to said cradle structure, said cradle structure being arranged above a fluid level of the cleaning fluid in said cleaning fluid container during the feeding of said cleaning fluid to said cradle structure, and a drying device.

12. A device as claimed in claim 11, wherein the drying device comprises an impeller.

13. A device as claimed in claim 12, wherein the drying device further comprises a heater.

14. A cleaning device comprising:

a cradle structure adapted to receive a shaving head of a shaving apparatus, said cradle structure being permanently open to atmosphere, a cleaning fluid container, and a feed device for feeding cleaning fluid from said cleaning fluid container to said cradle structure, said cradle structure being arranged above a fluid level of the cleaning fluid in said cleaning fluid container during the feeding of said cleaning fluid to said cradle structure.

15. A cleaning device comprising:

a cradle structure adapted to receive a shaving head of a shaving apparatus, a cleaning fluid container, a feed device for feeding cleaning fluid from said cleaning fluid container to said cradle structure, said cradle structure being arranged above a fluid level of the cleaning fluid in said cleaning fluid container during the feeding of said cleaning fluid to said cradle structure, a collecting dish and a filter, said collecting dish being positioned underneath the cradle structure and including an outlet opening connecting with the filter, and a hose member permeable to the cleaning fluid provided between the collecting dish and the filter.

16. A device as claimed in claim 15, wherein the hose member is immersed in the cleaning fluid held in the cleaning fluid container.

17. A cleaning device comprising:

a cradle structure adapted to receive a shaving head of a shaving apparatus, a cleaning fluid container, a feed device for feeding cleaning fluid from said cleaning fluid container to said cradle structure, said cradle structure being arranged above a fluid level of the cleaning fluid in said cleaning fluid container during the feeding of said cleaning fluid to said cradle structure, said feed device including a suction side and a delivery side, and a collecting dish and a filter, said collecting dish being positioned underneath the cradle structure and including an outlet opening connecting with the filter, the outlet opening being connected to the suction side of the feed device, the filter being in communication with the delivery side of the feed device.

18. A cleaning device comprising:

a cradle structure adapted to receive a shaving head of a shaving apparatus, a cleaning fluid container, a feed device for feeding cleaning fluid from said cleaning fluid container to said cradle structure, said cradle structure being arranged above a fluid level of the cleaning fluid in said cleaning fluid container during the feeding of said cleaning fluid to said cradle structure, and a bracket for insertion of the shaving apparatus therein.

19. A device as claimed in claim 18, further comprising a switch for interlocking the shaving apparatus to the bracket.

20. A device as claimed in claim 9, further comprising a switch spring, the switch being movable against the force of the spring from an unlockable position into a position interlocking the shaving apparatus.

21. A device as claimed in claim 20, wherein said switch is configured such that the interlocking position electrically activates the shaving apparatus and the cleaning device.

22. A device as claimed in claim 19, further comprising an electrical control circuit, wherein the switch is adapted to be connected to the electrical control circuit to activate the cleaning device for a predetermined period of time.

23. A device as claimed in claim 22, further comprising a drying device, wherein the electrical control circuit, following cleaning of the shaving head, is configured to activate the drying device of the shaving apparatus for a predetermined period of time.

24. A device as claimed in claim 22, wherein the electric control circuit is configured to control the cleaning device.

25. A device as claimed in claim 22 wherein the electric control circuit is configured to supply the cradle structure with cleaning fluid from the cleaning fluid container for the duration of the cleaning operation of the shaving head.

26. A device as claimed in claim 19, wherein an electric control circuit is configured to cancel the interlock after cleaning of the shaving head.

27. A cleaning device comprising:

a cradle structure adapted to receive a shaving head of a shaving apparatus, a cleaning fluid container, said cradle structure including an outer port connecting the cradle structure with the cleaning fluid container, a feed device for feeding cleaning fluid from said cleaning fluid container to said cradle structure, said cradle structure being arranged above a fluid level of the cleaning fluid in said cleaning fluid container during the feeding of said cleaning fluid to said cradle structure, and a hose member permeable to the cleaning fluid provided between the overflow device and the cleaning fluid container, said hose member being immersed in the cleaning fluid held in the cleaning fluid container.

* * * * *

UNITED STATES PATENT AND TRADEMARK OFFICE

CERTIFICATE OF CORRECTION

PATENT NO. : 5,711,328

DATED : January 27, 1998

INVENTOR(S) : Gebhard Braun

It is certified that error appears in the above-identified patent and that said Letters Patent is hereby corrected as shown below:

Col. 10, l. 14, "10" should be --50--.

Col. 15, l. 21, "9" should be --19--.

Signed and Sealed this

Twenty-ninth Day of September, 1998

*Attest:*

*Attesting Officer*

BRUCE LEHMAN

*Commissioner of Patents and Trademarks*